US005695253A

United States Patent [19]

Jenkins

[11] Patent Number: 5,695,253

[45] Date of Patent: Dec. 9, 1997

[54] ARTICLE OF FURNITURE

[76] Inventor: Steven Robert Jenkins, 7200 South Southdale, Boise, Id. 83709

[21] Appl. No.: 704,827

[22] Filed: Aug. 28, 1996

[51] Int. Cl.[6] ..... A47C 7/02

[52] U.S. Cl. ..... 297/452.64; 297/452.23; 297/344.21; 297/258.1; 297/452.2

[58] Field of Search ..... 297/452.18, 452.63, 297/452.21, 452.23, 452.17, 451.9, 452.22, 452.24, 452.64, 344.21, 344.26, 258.1, 452.2, 452.29; D6/369, 370

[56] References Cited

U.S. PATENT DOCUMENTS

| | | | |
|---|---|---|---|
| D. 168,943 | 2/1953 | Johnson | D6/369 |
| D. 179,376 | 12/1956 | Breed | 297/344.21 X |
| D. 200,533 | 3/1965 | Hopkins | 297/452.63 X |
| D. 285,874 | 9/1986 | McCaffrey | D6/369 X |
| 409,445 | 8/1889 | Beebe | 297/452.23 |
| 575,300 | 1/1897 | Homer | 297/452.22 |
| 2,684,709 | 7/1954 | Schawinsky | 297/452.64 X |
| 2,708,476 | 5/1955 | Eames | 297/452.64 |
| 2,785,733 | 3/1957 | Witty | 297/452.64 X |
| 2,845,699 | 8/1958 | Woodard | 297/452.64 X |
| 2,916,084 | 12/1959 | Bottemiller et al. | 297/344.26 X |
| 3,225,431 | 12/1965 | Woodard | 297/452.64 X |
| 3,226,161 | 12/1965 | Platner | 297/452.63 X |
| 3,463,145 | 8/1969 | Whitaker | 128/24 |
| 3,768,864 | 10/1973 | Niewulis | 297/452.17 X |
| 3,834,759 | 9/1974 | Panton | D6/370 X |
| 3,899,210 | 8/1975 | Samhammer et al. | 297/452.17 X |
| 4,188,983 | 2/1980 | Graham et al. | 297/451.9 X |
| 5,088,473 | 2/1992 | Chen et al. | 128/25 R |
| 5,165,389 | 11/1992 | Ting-Qi et al. | 128/25 R |
| 5,314,240 | 5/1994 | Ashi et al. | 297/452.15 |
| 5,338,099 | 8/1994 | Ashi et al. | 297/452.33 |
| 5,411,316 | 5/1995 | Lovegrove | 297/452.15 |

FOREIGN PATENT DOCUMENTS

| | | | |
|---|---|---|---|
| 1141762 | 12/1962 | Germany | 297/452.18 |

*Primary Examiner*—Milton Nelson, Jr.
*Attorney, Agent, or Firm*—David L. Volk

[57] ABSTRACT

A plurality of support members are connected to a ring member, forming a substantially flat, rigid bottom with side, front and rear portions forming obtuse angles with the bottom. A substantially planar base member is connected to the bottom of the seating apparatus, and a seat base is connected to the underside of the seating apparatus.

3 Claims, 3 Drawing Sheets

ARTICLE OF FURNITURE

BACKGROUND OF THE INVENTION

1. Field of the Invention

The present invention relates to furniture, specifically to a structure for holding a pillowy, flexible cushion therein and for sitting upon.

2. Description of the Related Art

Soft, pillowy, flexible cushions for sitting upon are well known in the prior art. Such cushions are generally constructed of a fabric casing with chopped foam therein. These cushions are typically used by placing the cushion on the floor and then sitting thereon. These flexible cushions permit a user to comfortably sit in a variety of positions, and to shape the cushion in various ways to suit his or her individual preference and reclining style.

A problem with these cushions is that because of their softness and flexibility, and because they rest directly on the floor, they can be difficult to get onto and off of for use, particularly for an older person.

What is needed is an apparatus for raising the cushion off of the floor and cradling the cushion there-on, thereby forming a chair-like structure. Such an apparatus would retain the advantages of the comfort and moldability of the soft, flexible cushions, but would eliminate the disadvantages of the cushion being placed directly on the floor. Such a device would make it easier to get on and off of the cushion, adding to the satisfaction and decreasing the frustrations of the user. Such a device would also extend the use of these soft cushions to older persons who previously may have chosen not to use them because of their associated difficulties. Such a device should be designed to permit the cushion to conform in shape to accomodate a variety of sitting and reclining styles.

SUMMARY OF THE INVENTION

The seating apparatus of the present invention includes a ring member through which a soft, flexible cushion may be inserted. A plurality of support members are connected to the ring member, forming a substantially flat, rigid bottom with side, front and rear portions forming obtuse angles with the bottom. A substantially planar base member is connected to the bottom of the seating apparatus, and a seat base is connected to the underside of the seating apparatus.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION

Figure 1:
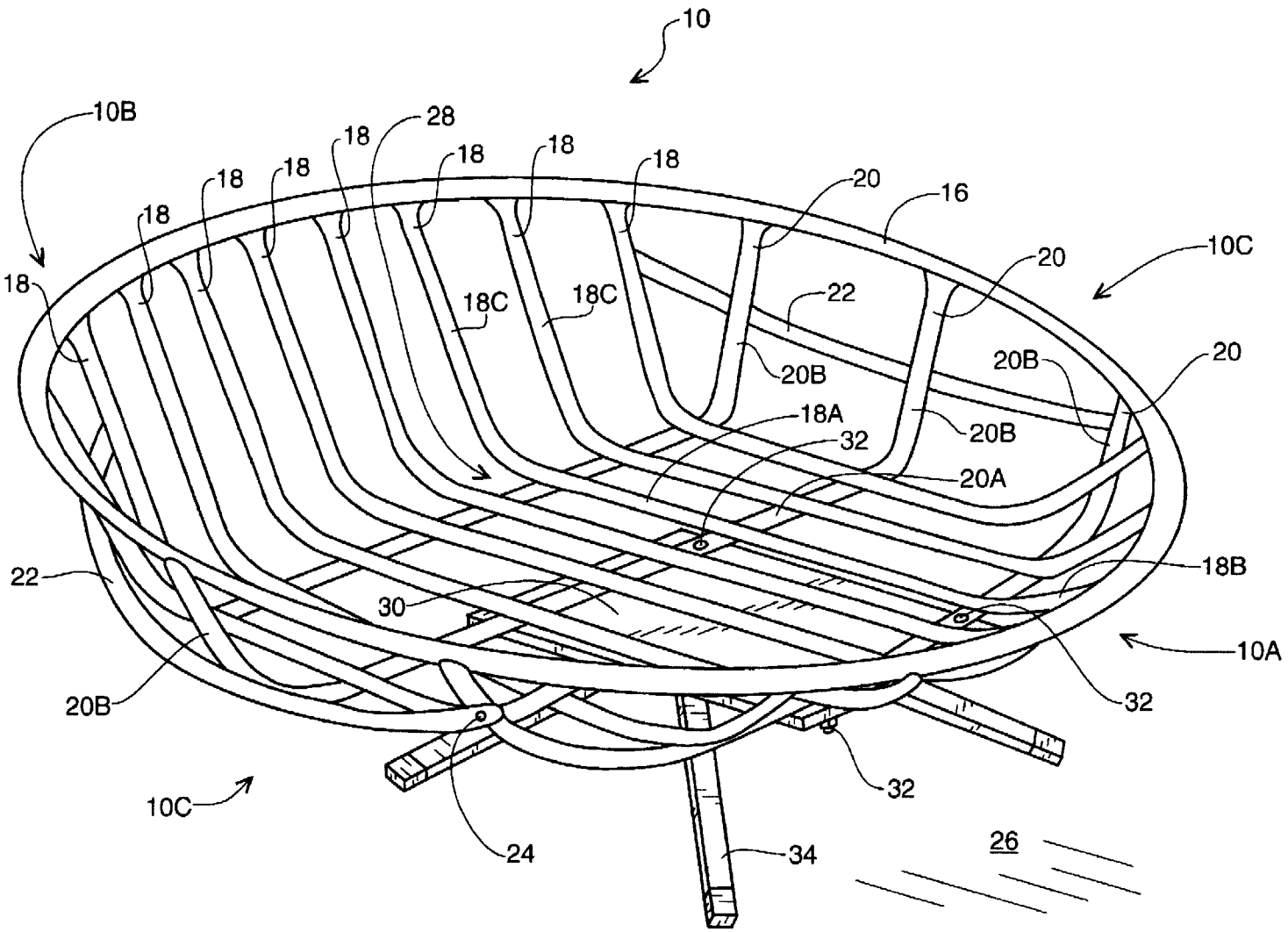
FIG. 1 is a perspective view of an apparatus for holding a pillowy cushion off of a floor for sitting thereon.
Figure 2:
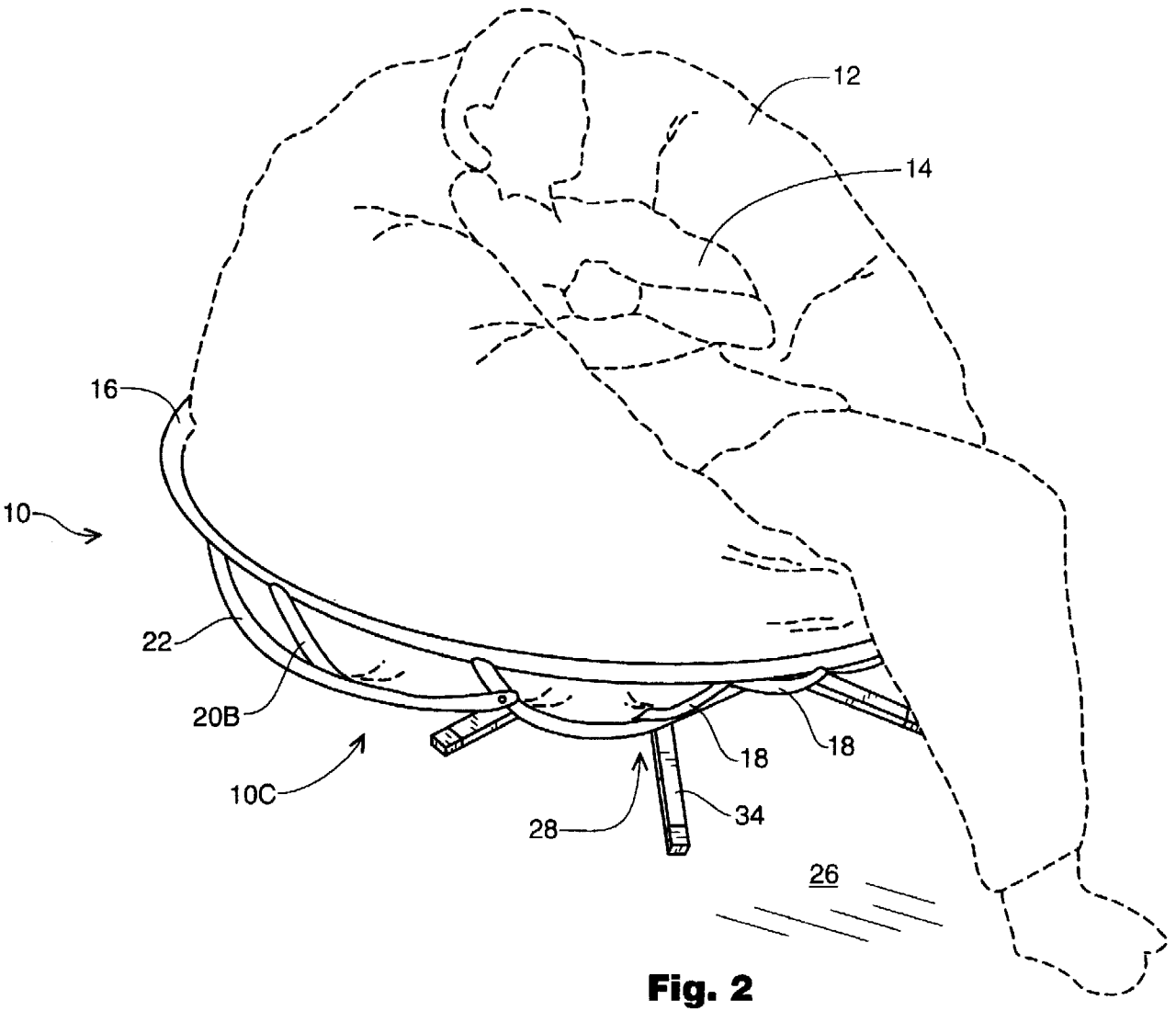
FIG. 2 is a perspective view of the apparatus in use, with the user in a conventional seated position.

FIG. 1 is a perspective view of a seating apparatus 10 for holding a pillowy cushion 12 off of a floor 26 for sitting thereon. FIG. 2 shows the apparatus 10 with the cushion 12 positioned thereon, with a user 14 positoned on the cushion 12 in a conventional seated manner.

The apparatus 10 includes a ring member 16 through which the cushion 12 is inserted for use. The ring member 16 is in the form of a tube bent in a substantially oblong shape. Although an oblong shape is shown and described, a substantially circular shape is within the scope of the present invention.

A plurality of first support members 18 extend across the ring member 16. Each first support member 18 is substantially tubular and is bent to form a substantially straight middle section 18A, a front arm 18B, and a rear arm 18C. The arms 18B, 18C each form a radial bend at an end of the straight middle section 18A and extend therefrom at an obtuse angle with the middle section 18A. The arms 18B, 18C extend from the middle section 18A such that the entire first support member 18 cuts through a single geometrical plane. The middle section 18A is disposed substantially parallel to the short axis of symmetry of the oblong ring member 16. The front arm 18B is attached at its distal end to the ring member 16 at a front portion 10A of the seating apparatus 10. The rear arm 18C is attached at its distal end to the ring member 16 at a rear portion 10B of the seating apparatus 10. The front arm 18B is shorter than the rear arm 18C.

A plurality of second support members 20 extend across the ring member 16. Each second support member 20 is substantially tubular and is bent to form a substantially straight central section 20A and side arms 20B. The side arms 20B each form a radial bend at an end of the central section 20A and extend therefrom at an obtuse angle with the central section 20A. The side arms 20B extend from the central section 20A such that the entire second support member 20 cuts through a single geometrical plane. The central section 20A is disposed substantially parallel to the long axis of symmetry of the oblong ring member 16. The side arms 20B are each attached at its distal end to the ring member 16 at sides 10C of the seating apparatus 10. The side arm 20B at one end of the central section 20A is substantially the same size as the side arm 20B at the other end of the central section 20A.

A side support member 22 extends from an endmost rear arm 18C to a frontmost side arm 20B. The side support member 22 is substantially tubular and provides support to the rearmost and center side arms 20B, helping to restrain the rearmost and center side arms 20B from outward deflection.

The first support members 18, second support members 20, side support members 22 and ring member 16 are connected to one another as shown and described with conventional fasteners 24 such as lag bolts or sheet metal screws. Although the fasteners 24 are primarily not visible in the views shown, they are generally provided at every intersection point and connection point between members 16, 18, 20, 22.

The middle sections 18A and the central sections 20A when configured as shown and described form a rigid flat bottom 28 of the seating apparatus 10.

Because the front arms 18B are shorter than the rear arms 18C, the plane of the ring member 16 is inclined from the front portion 10A to the rear portion 10B with respect to the floor 26 upon which the seating apparatus 10 is placed. Because of this configuration, the user 14 has sufficient height at the rear portion 10B of the seating apparatus 10 to support his or her back, and the front portion 10A of the seating apparatus 10B is sufficiently low for the user's legs to rest there-across in a conventional position when the user 14 is seated.

Because the front and rear arms 18B, 18C form an obtuse angle with the middle sections 18A and because the side arms 20B form an obtuse angle with the central sections 20A, the cushion 12 may readily spread outward when a user 14 sits there-upon.

Figure 3:
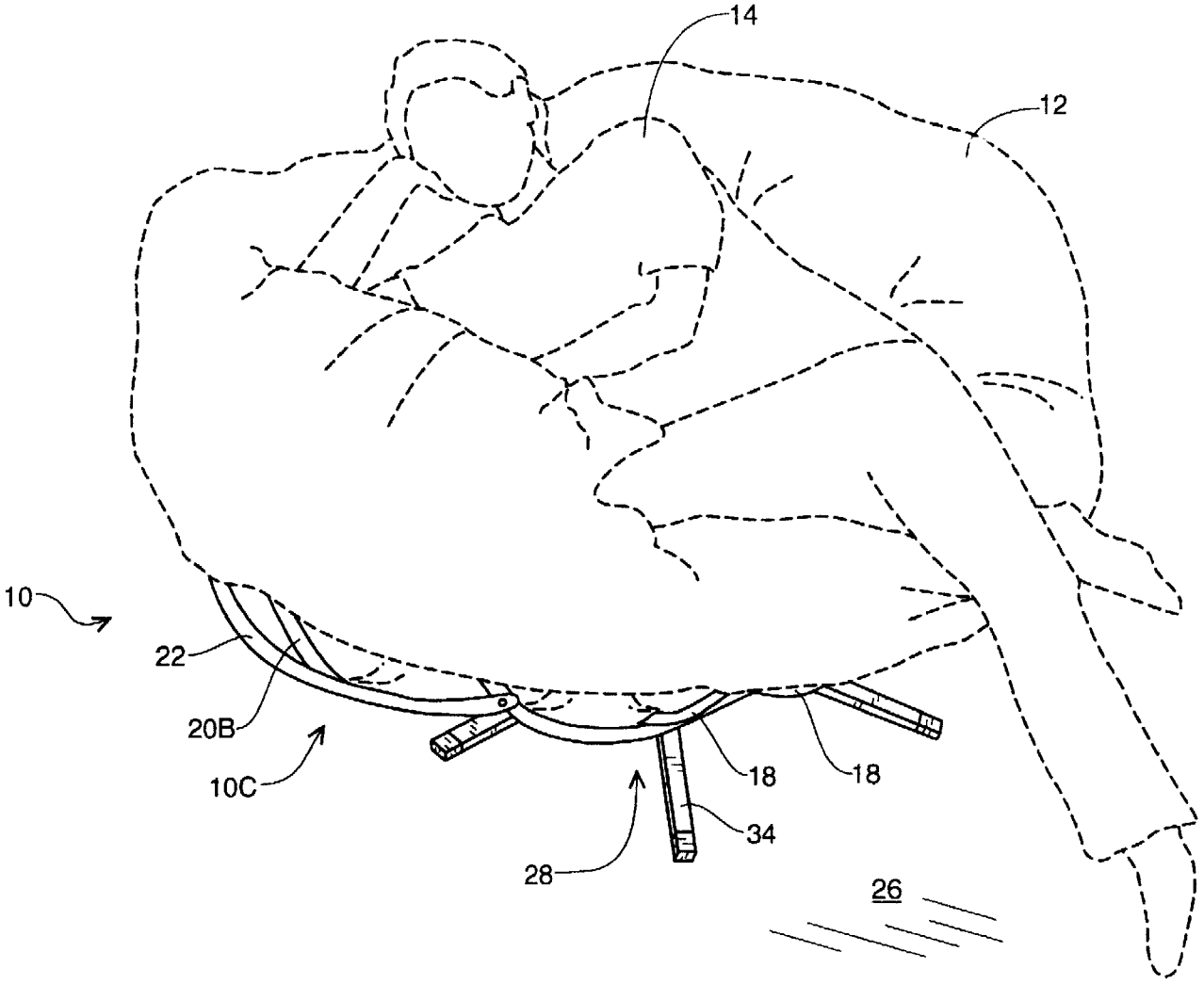
FIG. 3 is a perspective view of the apparatus in use, with the user in a reclining position there-upon.

Because the middle sections 18A and the central sections 20A form a rigid flat bottom 28 of the seating apparatus 10, the cushion 12 may spread out flatly there-upon. This is especially important when, as shown in FIG. 3, a user 14 wishes to adopt a reclining position which tends to compress a large central portion of the cushion 12. This compression tends to cause the underside of the cushion 12 to spread outward against the bottom 28 of the seating apparatus 10. By contrast, if the bottom 28 of the seating apparatus 10 were more bowl-shaped than flat, the cushion 12 would not spread out sufficiently against the bottom 28 of the seating apparatus 10, and it would be difficult to compress a large central portion of the cushion 12, making a reclining position difficult and uncomfortable for the user 14.

A substantially planar base member 30 is attached to the bottom 28 of the seating apparatus 10 via conventional fasteners such as lag bolts 32. A seat base 34 is attached to the underside of the base member 30. The seat base 34 is a conventional manufactured unit such as a rocker or glider base, manufactured for use with conventional rocker and glider furniture. The seat base 34 conventionally includes legs, a mechanism for accomplishing the rocking or gliding motion, and structure for installing the seat base 34 to the rocker or glider furniture. Examples of such a unit include rocker and glider bases manufactured by Legget & Platt Corporation of Simpsonville, K.Y. The installation of the seat base 34 on the seating apparatus 10 permits the seating apparatus 10 to be used as a rocker or glider, and may also permit the seating apparatus 10 to swivel about the seat base 34, depending on the seat base 34 used. Because the seat base 34 is already known in the prior art, the details there-of are not disclosed herein. Because the structure for installing the seat base 34 is a part of the seat base 34 and is thus already known in the prior art, and because the seat base 34 is attached to the base member 30 in a conventional manner, the details there-of are not disclosed herein.

Thus the seating apparatus 10 of the present invention retains the advantages of the comfort and moldability of the soft, flexible cushions 12, but eliminates the disadvantages of the cushion being placed directly on the floor. The seating apparatus 10 makes it easier to get on and off of the cushion 12, extending the use of these soft cushions 12 to older persons who previously may have chosen not to use them because of their associated difficulties. Because of the structure of the seating apparatus 10, the cushion 12 may conform in shape to accomodate a variety of sitting and reclining styles.

The foregoing description is included to describe the preferred embodiment of the present invention, and is not meant to limit the scope of the invention. From the foregoing description, many variations will be apparent to those skilled in the art that would be encompassed by the spirit and scope of the invention. The scope of the invention is to be limited only by the following claims and their legal equivalents.

The invention claimed is:

1. An article of furniture for holding a cushion there-upon and for sitting and reclining thereon, comprising:

a. a planar ring member adapted for insertion of the cushion there-through;

b. a plurality of spaced, parallel, elongated first support members;

c. each of the first support members bent to form a straight middle section, a front arm and a rear arm;

d. the front arm and the rear arm each forming an obtuse angle with the middle section;

e. the front arm and the rear arm extending from the middle section such that the entire first support member resides within a single geometric plane;

f. the front arm being shorter than the rear arm;

g. a plurality of spaced, parallel elongated second support members;

h. each of the second support members bent to form a straight central section, a first side arm and a second side arm;

i. the first side arm and the second side arm each forming an obtuse angle with the central section;

j. the first side arm and the second side arm extending from the central section such that the entire second support member resides within a single geometric plane;

k. each of the central sections disposed perpendicular to the middle sections;

l. the first and the second side arms being substantially the same length as each other;

m. the middle sections and the central sections being non-interlaced and configured to form a rigid flat bottom for resting the cushion thereon;

n. each of the front arms attached at a distal end thereof to the ring member in such a manner as to form a front barrier for helping to retain the cushion on the flat bottom;

o. each of the rear arms attached at a distal end thereof to the ring member in such a manner as to form a rear barrier opposite the front barrier for helping to retain the cushion on the flat bottom;

p. each of the first side arms attached at a distal end thereof to the ring member in such a manner as to form a first side barrier for retaining the cushion on the flat bottom;

q. each of the second side arms attached at a distal end thereof to the ring member in such a manner as to form a second side barrier for retaining the cushion on the flat bottom, wherein a person may recline on the cushion in a variety of positions, and the cushion will readily spread outward toward and be retained by the front, the rear, the first side, and the second side barriers;

r. a floor support means for supporting the rigid flat bottom above a floor surface.

2. The article of furniture of claim 1, wherein the ring member is substantially oblong.

3. The article of furniture of claim 2, wherein the first support members and the second support members are constructed of tubular steel.

* * * * *